US010794133B2

(12) United States Patent
Pena et al.

(10) Patent No.: US 10,794,133 B2
(45) Date of Patent: Oct. 6, 2020

(54) CONVEYANCE MEMBER FOR A RESOURCE EXPLORATION AND RECOVERY SYSTEM

(71) Applicants: Elias Pena, Katy, TX (US); Bryan Tindall, Edmond, OK (US)

(72) Inventors: Elias Pena, Katy, TX (US); Bryan Tindall, Edmond, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 146 days.

(21) Appl. No.: 15/947,163

(22) Filed: Apr. 6, 2018

(65) Prior Publication Data

US 2019/0309590 A1 Oct. 10, 2019

(51) Int. Cl.

| | |
|---|---|
| ***E21B 23/12*** | (2006.01) |
| ***E21B 23/04*** | (2006.01) |
| ***E21B 33/08*** | (2006.01) |
| ***E21B 33/072*** | (2006.01) |
| ***E21B 23/14*** | (2006.01) |

(52) U.S. Cl.

CPC ..... *E21B 23/12* (2020.05); *E21B 23/04* (2013.01); *E21B 23/14* (2013.01); *E21B 33/072* (2013.01); *E21B 33/08* (2013.01)

(58) Field of Classification Search

CPC ..... E21B 23/002; E21B 23/04; E21B 23/14; E21B 23/03; E21B 33/08; E21B 33/072; E21B 33/10

See application file for complete search history.

(56) References Cited

U.S. PATENT DOCUMENTS

| | | | | |
|---|---|---|---|---|
| 5,934,378 | A | 8/1999 | Tchakarov | |
| 2011/0232900 | A1 | 9/2011 | Ring et al. | |
| 2012/0217004 | A1 | 8/2012 | Yee et al. | |
| 2013/0068451 | A1* | 3/2013 | Getzlaf | E21B 43/00 166/250.07 |
| 2014/0131953 | A1* | 5/2014 | Lehr | E21B 33/126 277/323 |
| 2016/0084021 | A1 | 3/2016 | Jewett et al. | |

OTHER PUBLICATIONS

Notification of Transmittal of the International Search Report of the International Searching Authority, or the Declaration; PCT/US2019/025823; dated Jul. 23, 2019; 4 pages.

Notification of Transmittal of the Written Opinion of the International Searching Authority, or the Declaration; PCT/US2019/025823; dated Jul. 23, 2019; 5 pages.

* cited by examiner

*Primary Examiner* — David Carroll

(74) *Attorney, Agent, or Firm* — Cantor Colburn LLP

(57) ABSTRACT

A downhole system includes a conveyance member having a body including an outer surface, an inner surface, and an interior portion. An actuator is arranged in the interior portion and a fluid trap is provided on the outer surface and operatively connected with the actuator. The fluid trap is selectively positionable in a first configuration establishing a continuously annular surface projecting radially outwardly of the body when being guided downhole and a second configuration allowing fluid to bypass the body when being withdrawn from a wellbore.

18 Claims, 5 Drawing Sheets

CONVEYANCE MEMBER FOR A RESOURCE EXPLORATION AND RECOVERY SYSTEM

BACKGROUND

In the resource exploration and recovery industry, wirelines are routinely run downhole to a selected location in a wellbore. Typically, a wireline is pumped downhole with a fluid, such as mud or water. The wireline is used to convey various devices such as tools, measurement devices, and/or other components downhole. Pumping a wireline down a substantially vertical or angled wellbore is typically much more efficient than pumping a wireline along horizontal or substantially horizontal portions of a wellbore.

Pump down efficiency is a concern when guiding wirelines downhole. A reduced pump down efficiency leads to time delays for moving a device downhole. Reduced efficiency also leads to greater expense due to the amount of fluid needed to move a wireline along horizontal wellbore portions. That is, much of the fluid employed in a pump down operation bypasses the wireline along horizontal portions of the wellbore without providing much, if any, force. Accordingly, the art would be receptive of a system that reduces bypass flow and increases pump down efficiency for wirelines along horizontal and/or substantially horizontal portions of a wellbore.

SUMMARY

Disclosed is a downhole system includes a conveyance member having a body including an outer surface, an inner surface, and an interior portion. An actuator is arranged in the interior portion and a fluid trap is provided on the outer surface and operatively connected with the actuator. The fluid trap is selectively positionable in a first configuration establishing a continuously annular surface projecting radially outwardly of the body when being guided downhole and a second configuration allowing fluid to bypass the body when being withdrawn from a wellbore.

Also disclosed is a method of guiding a downhole tool into a wellbore including guiding a downhole tool into the wellbore, establishing a fluid trap on a conveyance member connected to the downhole tool, introducing a pump down fluid into the wellbore against the fluid trap, and shifting the downhole tool along the wellbore with the fluid.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
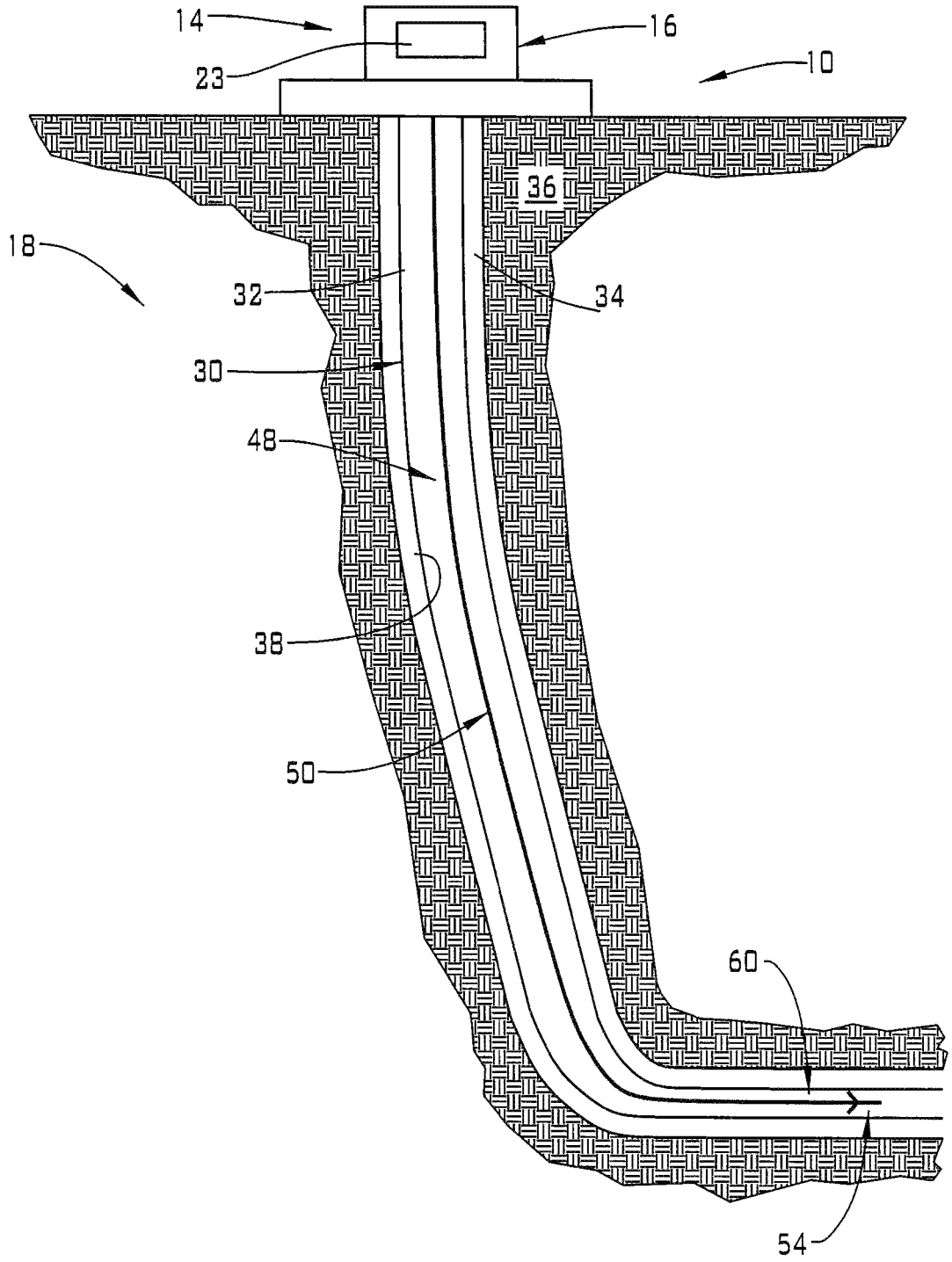
FIG. 1 depicts a resource exploration and recovery system having a downhole system including a conveyance member, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein. Surface system 16 may include additional systems such as pumps, fluid storage systems, cranes and the like (not shown).

Second system 18 may include a tubular string 30, formed from one or more tubulars 32, which extends into a wellbore 34 formed in formation 36. Wellbore 34 includes an annular wall 38 which may be defined by a surface of formation 36. In an exemplary aspect, a downhole system 48 is guided into tubular string 30. Downhole system 48 may take the form of a wireline 50 that supports a tool mechanism 54. A conveyance member 60 may be provided on wireline 50.

Figure 2:
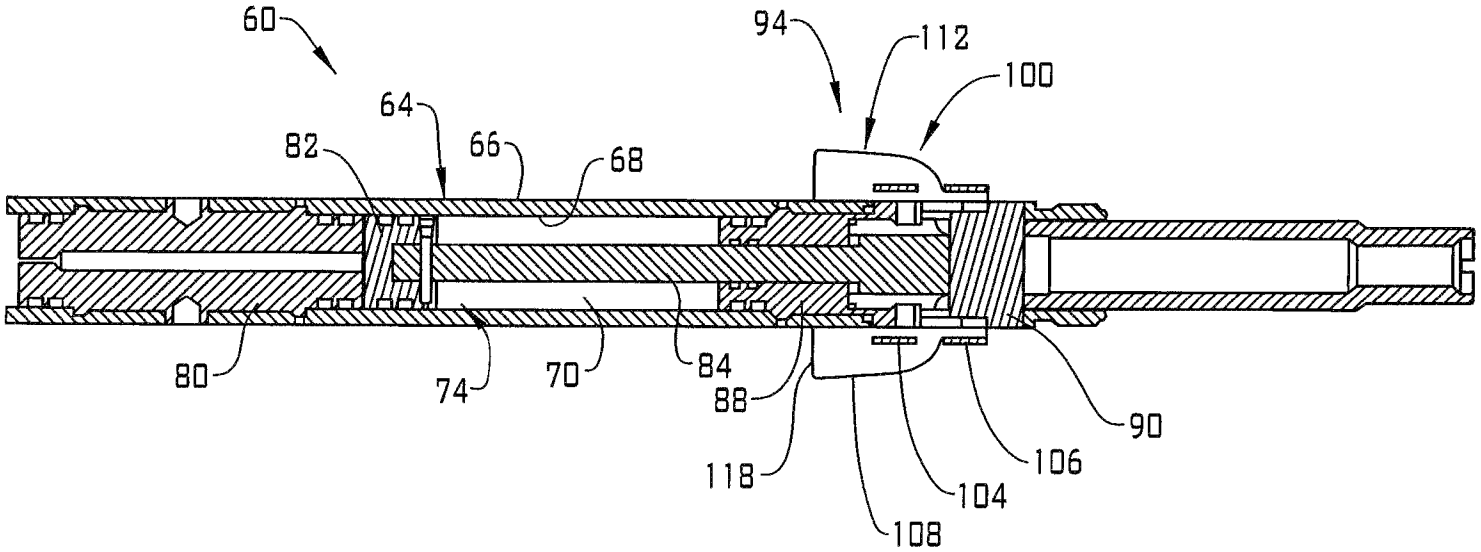
FIG. 2 depicts a conveyance member in a first or deployment configuration, in accordance with an aspect of an exemplary embodiment.
Figure 3:
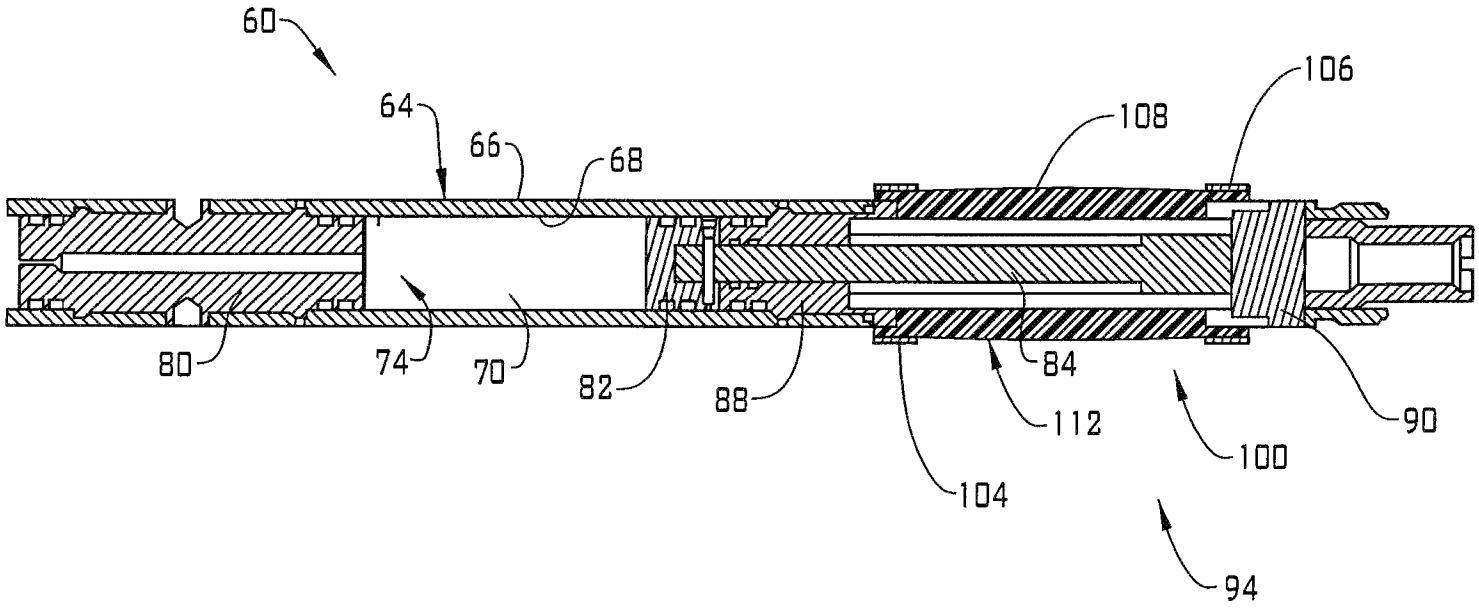
FIG. 3 depicts the conveyance member of FIG. 2 preparing to be withdrawn from a wellbore in a second or disabled configuration, in accordance with an exemplary embodiment.

Referring to FIGS. 2-3 and with continued reference to FIG. 1, conveyance member 60, in accordance with an exemplary aspect, includes a body 64 having an outer surface 66 and an inner surface 68 that defines an interior portion 70. An actuator system 74 is arranged in interior portion 70. Actuator system 74 includes an actuator 80 including a central passage (not separately labeled) that may allow an actuation fluid, such as high velocity gases, hydraulic fluid and the like, toward a piston 82. Piston 82 is connected to a rod 84 that extends through a stop member 88 to a slider 90. Slider 90 is selectively shifted to disable a fluid trap 94.

In an embodiment, fluid trap 94 includes a wiper 100 that extends radially outwardly of body 64 toward an inner surface (not separately labeled) of tubular string 30. Wiper 100 may engage with, or terminate near the inner surface. Wiper 100 includes a first end 104, a second end 106, and an intermediate portion 108 that extends therebetween. First end 104 may be connected with stop member 88 and second end 106 may be connected with slider 90. Intermediate portion 108 defines a continuously annular surface 112 that extends about body 64.

In accordance with an exemplary aspect, in a first configuration, wiper 100 may include a concave surface 118 that forms a cup (not separately labeled) for capturing fluid introduced into tubular string 30. The fluid acts upon wiper 100 to move downhole system 48 into wellbore 34 to deploy, for example, tool mechanism 54. It should be understood that tool mechanism 54 may take on a variety of forms. Once in position, actuator system 74 may be activated to deliver a force onto piston 82. Piston 82 travels within interior potion 70 causing slider 90 to shift second end 106 of wiper relative to, and away from, first end 106. Once shifted intermediate portion 108 may lie against or near to outer surface 66 allowing wireline 50 to be readily withdrawn from wellbore 34.

Figure 4:
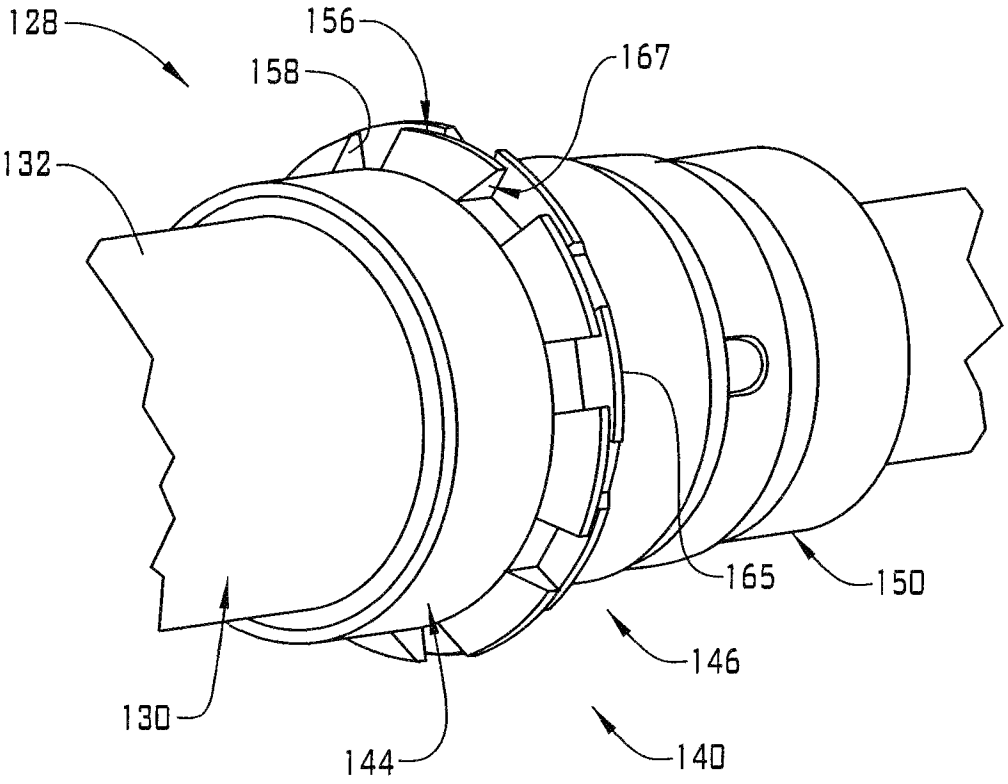
FIG. 4 depicts a conveyance member in a first or deployment configuration, in accordance with another aspect of an exemplary embodiment.
Figure 5:
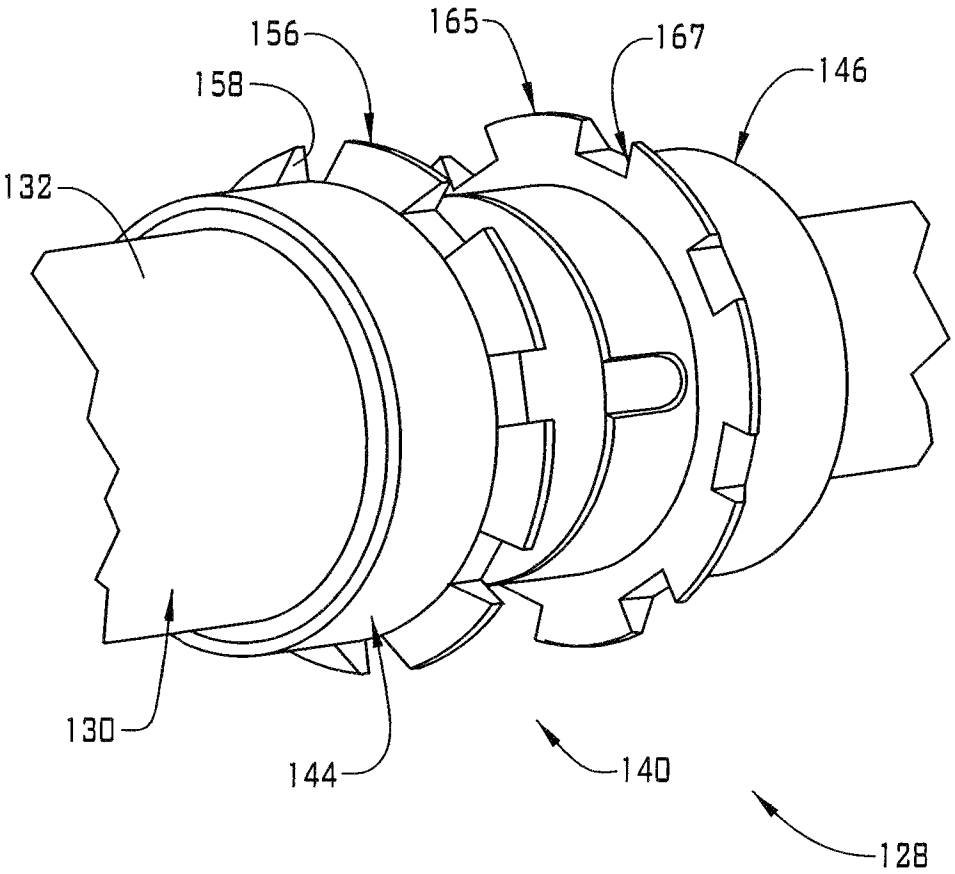
FIG. 5 depicts the conveyance member of FIG. 3 preparing to be withdrawn from a wellbore in a second or disabled configuration, in accordance with an exemplary embodiment.

Reference will now follow to FIGS. 4-5 in describing g a conveyance member 128 in accordance with another aspect of an exemplary embodiment. Conveyance member 128 includes a body 130 having an outer surface 132 and an interior portion (not shown) that may house an actuation system (also not shown). Body 130 supports a fluid trap 140 having a first trap member 144 and a second trap member 146. Second trap member 146 may be connected to a slider 150 and is selectively shiftable relative to first trap member 144 to, for example, disable fluid trap 140.

In accordance with an exemplary aspect, first trap member 144 includes a plurality of wall members 156 and a plurality of void sections 158 interposed between adjacent ones of the plurality of wall members 156. Similarly, second trap member 146 includes a plurality of wall elements 165 and a plurality voids interposed between adjacent ones of the plurality of wall elements 165. In a first configuration shown in FIG. 4, each of the plurality of wall elements 165 register with a corresponding one of the plurality of void sections 158 and the plurality of wall members 156 register with corresponding ones of the plurality of voids 167 to form a continuously annular surface 175.

When it is desired to withdraw downhole system 48 from wellbore 34, fluid trap 140 may be disabled. In an embodiment, second trap member 146 may be shifted axially relative to, and away from, first trap member 144. In this configuration, any fluid that may be in tubular string 30 may readily flow through each of the plurality of void sections 158 and the plurality of voids 167 allowing wireline 50 to be withdrawn.

At this point it should be understood that exemplary embodiments describe a conveyance member that may be deployed and acted upon by fluid to send a wireline downhole. The fluid trap extends outward from the body capturing fluid. The fluid trap limits fluid from passing by the downhole system without providing some amount of motive force. In this manner, the exemplary embodiments save time, and fluid for delivering a component, such as a tool into a wellbore, particular into horizontal portions of a wellbore. It should also be understood that the fluid trap in accordance with exemplary embodiments may be configured for multiple uses or, may be a single use component that could be disposed downhole following use.

Set forth below are some embodiments of the foregoing disclosure:

Embodiment 1: A downhole system including a conveyance member having a body including an outer surface, an inner surface, and an interior portion; an actuator arranged in the interior portion; and a fluid trap provided on the outer surface and operatively connected with the actuator, the fluid trap being selectively positionable in a first configuration establishing a continuously annular surface projecting radially outwardly of the body when being guided downhole and a second configuration allowing fluid to bypass the body when being withdrawn from a wellbore.

Embodiment 2: The downhole system according to any prior embodiment, wherein the fluid trap comprises a selectively radially outwardly deployable wiper.

Embodiment 3: The downhole system according to any prior embodiment, wherein the selectively radially outwardly deployable wiper includes a first end, a second end, and an intermediate portion extending therebetween.

Embodiment 4: The downhole system according to any prior embodiment, wherein the second end is selectively moveable relative to the first end.

Embodiment 5: The downhole system according to any prior embodiment, wherein the intermediate portion defines the continuously annular surface.

Embodiment 6: The downhole system according to any prior embodiment, wherein the continuously annular surface defines a concave surface.

Embodiment 7: The downhole system according to any prior embodiment, wherein the fluid trap includes a first trap member and a second trap member, the first trap member being selectively positionable relative to the second trap member to form the continuously annular surface.

Embodiment 8: The downhole system according to any prior embodiment, wherein the second trap member is arranged at the first trap member in the first configuration.

Embodiment 9: The downhole system according to any prior embodiment, wherein the second trap member is spaced from the first trap member in the second configuration.

Embodiment 10: The downhole system according to any prior embodiment, wherein the first trap member includes a plurality of wall members and a plurality of void sections arranged between respective ones of the plurality of wall members, and the second trap member includes a plurality of wall elements and a plurality of voids arranged between respective ones of the plurality of wall elements.

Embodiment 11: The downhole system according to any prior embodiment, wherein each of the plurality of wall members register with a corresponding one of the plurality of the voids and each of the plurality of wall elements register with a corresponding one of the void sections in the first configuration.

Embodiment 12: The downhole system according to any prior embodiment, wherein the plurality of void sections and the plurality of voids define a fluid bypass pathway in the second configuration.

Embodiment 13: A method of guiding a downhole tool into a wellbore including guiding a downhole tool into the wellbore; establishing a fluid trap on a conveyance member connected to the downhole tool; introducing a pump down fluid into the wellbore against the fluid trap; and shifting the downhole tool along the wellbore with the fluid.

Embodiment 14: The method of any prior embodiment, wherein establishing the fluid trap includes shifting a first end of a deployable wiper toward a second end of the deployable wiper to form a concave surface receptive of the pump down fluid.

Embodiment 15: The method of any prior embodiment, wherein establishing the fluid trap includes radially outwardly expanding a continuously annular surface into contact with a wall of the wellbore.

Embodiment 16: The method of any prior embodiment, further including disabling the fluid trap by shifting the first end away from the second end and withdrawing the downhole tool from the wellbore after disabling the fluid trap.

Embodiment 17: The method of any prior embodiment, wherein establishing the fluid trap includes shifting a first trap member toward a second trap member along the downhole tool.

Embodiment 18: The method of any prior embodiment, wherein establishing the fluid trap includes blocking a plurality of void sections of the first trap member with a corresponding plurality of wall elements of the second trap member, and blocking a plurality of voids on the second trap member with a corresponding plurality of wall members of the first trap member.

Embodiment 19: The method of any prior embodiment, further including disabling the fluid trap by shifting the second trap member away from the first trap member and withdrawing the downhole tool from the wellbore after disabling the fluid trap.

Embodiment 20: The method of any prior embodiment, wherein disabling the fluid trap includes unblocking the plurality of voids and the plurality of void sections.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifiers "about" and "substantially" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole system comprising:

a conveyance member having a body including an outer surface, an inner surface, and an interior portion;

an actuator arranged in the interior portion; and a fluid trap provided on the outer surface and operatively connected with the actuator, the fluid trap including a first trap member and a second trap member, the fluid trap being selectively positionable in a first configuration establishing a continuously annular surface projecting radially outwardly of the body when being guided downhole and a second configuration wherein the first trap member is spaced from the second trap member allowing fluid to bypass the body when being withdrawn from a wellbore.

2. The downhole system according to claim 1, wherein the fluid trap comprises a selectively radially outwardly deployable wiper.

3. The downhole system according to claim 2, wherein the selectively radially outwardly deployable wiper includes a first end, a second end, and an intermediate portion extending therebetween.

4. The downhole system according to claim 3, wherein the second end is selectively moveable relative to the first end.

5. The downhole system according to claim 3, wherein the intermediate portion defines the continuously annular surface.

6. The downhole system according to claim 5, wherein the continuously annular surface defines a concave surface.

7. The downhole system according to claim 1, wherein the first trap member is selectively positionable relative to the second trap member to form the continuously annular surface.

8. The downhole system according to claim 7, wherein the second trap member is arranged at the first trap member in the first configuration to form the continuously annular surface.

9. The downhole system according to claim 7, wherein the first trap member includes a plurality of wall members and a plurality of void sections arranged between respective ones of the plurality of wall members, and the second trap member includes a plurality of wall elements and a plurality of voids arranged between respective ones of the plurality of wall elements.

10. The downhole system according to claim 9, wherein each of the plurality of wall members register with a corresponding one of the plurality of the voids and each of the plurality of wall elements register with a corresponding one of the void sections in the first configuration.

11. The downhole system according to claim 9, wherein the plurality of void sections and the plurality of voids define a fluid bypass pathway in the second configuration.

12. A method of guiding a downhole tool into a wellbore comprising:

guiding a downhole tool into the wellbore;

establishing a fluid trap including a first trap member and a second trap member on a conveyance member connected to the downhole tool introducing a pump down fluid into the wellbore against the fluid trap; and shifting the downhole tool along the wellbore with the fluid; and disabling the fluid trap by separating the first trap member from the second trap member.

13. The method of claim 12, wherein establishing the fluid trap includes shifting a first end of a deployable wiper toward a second end of the deployable wiper to form a concave surface receptive of the pump down fluid.

14. The method of claim 13, wherein establishing the fluid trap includes radially outwardly expanding a continuously annular surface into contact with a wall of the wellbore.

15. The method of claim 12, wherein establishing the fluid trap includes shifting the first trap member toward the second trap member along the downhole tool.

16. The method of claim 15, wherein establishing the fluid trap includes blocking a plurality of void sections of the first trap member with a corresponding plurality of wall elements of the second trap member, and blocking a plurality of voids on the second trap member with a corresponding plurality of wall members of the first trap member.

17. The method of claim 16, further comprising:

withdrawing the downhole tool from the wellbore after disabling the fluid trap.

18. The method of claim 17, wherein disabling the fluid trap includes unblocking the plurality of voids and the plurality of void sections.

* * * * *